US005169286A

United States Patent [19]

Yamada

[11] Patent Number: 5,169,286

[45] Date of Patent: Dec. 8, 1992

[54] VARIABLE CAPACITY CENTRIFUGAL WATER PUMP WITH MOVABLE PRESSURE CHAMBER FORMED BY IMPELLER

[75] Inventor: Yutaka Yamada, 2-918, Aza Minote, Oaza Akaike, Nisshin-cho, Aichi-gun, Aichi-ken, Japan

[73] Assignees: Yutaka Yamada, Aichi; Aisin Seiki Kabushiki Kaisha, Kariya, both of Japan

[21] Appl. No.: 819,593

[22] Filed: Jan. 9, 1992

Related U.S. Application Data

[63] Continuation of Ser. No. 489,972, Mar. 7, 1990, abandoned.

[30] Foreign Application Priority Data

Mar. 9, 1989 [JP] Japan ..... 1-56775

[51] Int. Cl.[5] ..... F01D 21/12

[52] U.S. Cl. ..... 415/48; 415/49; 415/156; 415/157; 415/170.1; 416/181; 277/178; 277/205

[58] Field of Search ..... 415/12, 126, 129, 131, 415/156, 157, 47, 48, 49, 148, 151, 208.1, 170.1; 416/181; 277/178, 205

[56] References Cited

U.S. PATENT DOCUMENTS

| | | | |
|---|---|---|---|
| 2,005,193 | 6/1935 | Mayo | 415/12 |
| 2,090,401 | 8/1937 | Mayo | 415/47 |
| 4,752,183 | 6/1988 | Sakurai | 415/157 |
| 4,828,455 | 5/1989 | Kinbara et al. | 415/157 |

FOREIGN PATENT DOCUMENTS

| | | | |
|---|---|---|---|
| 0000517 | 2/1979 | European Pat. Off. | 277/205 |
| 2734479 | 2/1979 | Fed. Rep. of Germany | 416/181 |
| 3130760 | 2/1983 | Fed. Rep. of Germany | 277/205 |
| 0087891 | 7/1980 | Japan . | |
| 0087892 | 7/1980 | Japan | 415/131 |
| 0165798 | 12/1981 | Japan | 415/148 |
| 0096797 | 5/1987 | Japan | 415/157 |
| 0202780 | 8/1923 | United Kingdom | 415/49 |
| 0879513 | 10/1961 | United Kingdom | 277/178 |
| 0942648 | 11/1963 | United Kingdom | 416/181 |

*Primary Examiner*—Edward K. Look
*Assistant Examiner*—Christopher M. Verdier
*Attorney, Agent, or Firm*—Oblon, Spivak, McClelland, Maier & Neustadt

[57] ABSTRACT

This invention relates to an improvement on a centrifugal pump including: a casing defining an inlet path extending at the axial portion thereof, a turbine chamber communicating with the inlet path, and an outlet path disposed at the outer periphery portion of the turbine chamber; a drive shaft rotatably held in the casing; and a turbine fixed on the drive shaft and disposed rotatably in the turbine chamber. The turbine includes a disk shaped back plate fixed on the drive shaft; a plurality of blades formed integrally on a surface of the back plate at the inlet path side, extending in the axial direction, and disposed radially at intervals of equal angle; a cup shaped movable disk plate having a plurality of blade inserting holes being substantially larger than the cross sectional configuration of the blades, disposed movably on the drive shaft in the axial direction relatively with respect to the back plate, and forming a pressure chamber between itself and the back plate; and an urging member for urging the movable disk plate in the direction to the back plate; wherein pressure adjusting holes communicating with the pressure chamber are formed in the back plate or the movable disk plate at portions thereof adjacent to the drive shaft.

12 Claims, 5 Drawing Sheets

VARIABLE CAPACITY CENTRIFUGAL WATER PUMP WITH MOVABLE PRESSURE CHAMBER FORMED BY IMPELLER

This application is a Continuation of application Ser. No. 07/489,972, filed on Mar. 7, 1990, now abandoned.

BACKGROUND OF THE INVENTION

1. Field of the Invention

This invention relates to an improvement on a centrifugal pump. This centrifugal pump is suitable for use as an automobile centrifugal water pump for circulating engine cooling water.

2. Description of the Prior Art

Automobile centrifugal water pumps are classified into two types. One type is driven independently by a motor, a hydraulic actuator and the like without utilizing the rotation of an engine. The other type is connected to an engine by way of a belt and driven by utilizing the rotation of an engine together with a generator and an air-cooling fan.

When a centrifugal water pump driven by a motor is employed, the capacity of a battery and a generator should be increased, because the electricity consumption increases. When a centrifugal water pump driven by a hydraulic actuator is employed, extra apparatuses are required for the cooling system. Whereby the system gets complicated as a whole, the cost thereof gets expensive, and the space occupied by the system and the weight thereof increases.

On the other hand, when a centrifugal water pump driven by utilizing the rotation of an engine is employed, the system has the following advantages, i.e., the system is simple, the system fails less, and the system is efficient. However, the system has the following disadvantages as well, because the number of the revolutions of the centrifugal water pump increases or decreases in proportion to the number of the revolutions of the engine.

Namely, the flow amount of the cooling water is likely to become insufficient when the engine is running at low speeds, and the flow amount thereof is likely to get unnecessarily large when the engine is running at high speeds, because the number of revolutions of the engine falls in a very wide range. This results from the fact that the configuration of the turbine of the centrifugal water pump remains the same, and the dimensionless characteristic thereof accordingly always remains the same.

Consequently, a centrifugal water pump is proposed whose capacity is made variable by varying the configuration of the turbine. However, the pump capacities of the conventional centrifugal water pumps of this type are varied by utilizing the expansion and contraction of thermo-wax, or by utilizing the shape memory effect of shape memory alloy, thereby varying the configuration of the blades (for instance, varying the height of the blades), or thereby varying the installation angle of the blades. The pump capacities of these conventional centrifugal water pumps are made variable in accordance with the temperatures of the cooling water, and these conventional centrifugal pumps do not have a mechanism enabling the making of the pump capacities variable in accordance with the number of revolutions of the engine.

SUMMARY OF THE INVENTION

This invention has been developed in order to solve the above-mentioned problems. It is therefore an object of this invention to provide a centrifugal pump having a mechanism for varying the configuration of the turbine in accordance with the number of revolutions of the engine, thereby making the capacity thereof variable.

This invention relates to an improvement on a centrifugal pump comprising: a casing defining an inlet path extending at the axial portion thereof, a turbine chamber communicating with the inlet path, and an outlet path disposed at the outer periphery portion of the turbine chamber; a drive shaft rotatably held in the casing; and a turbine fixed on the drive shaft and disposed rotatably in the turbine chamber; wherein the turbine comprises: a disk shaped back plate fixed on the drive shaft; a plurality of blades formed integrally on a surface of the back plate at the inlet path side, extending in the axial direction, and disposed radially at intervals of equal angle; a cup shaped movable disk plate having a plurality of blade inserting holes being substantially larger than the cross sectional configuration of the blades, disposed movably on the drive shaft in the axial direction relatively with respect to the back plate, and forming a pressure chamber between itself and the back plate; and an urging member for urging the movable disk plate in the direction to the back plate; wherein pressure adjusting holes communicating with the pressure chamber are formed in the back plate or the movable disk plate at portions thereof adjacent to the drive shaft, and the opening area of the pressure adjusting holes is so set that the pressure in the pressure chamber is relatively greater than the pressure in front of the movable disk plate, whereby a forward pressing force is applied on the movable disk plate.

The casing is a component member for defining the following: the inlet path extending in the central portion of the centrifugal pump for taking in fluid from the outside of the centrifugal pump, the turbine chamber communicating with the inlet path for giving kinetic energy to the fluid, and the outlet path disposed at the outer periphery of the turbine chamber for discharging the fluid to the outside of the centrifugal pump.

The drive shaft is a shaft shaped component member held rotatably in the casing, and drives and rotates the turbine hereinafter described.

The turbine is a component member fixed on the drive shaft and disposed rotatably in the turbine chamber, and gives kinetic energy to the fluid introduced into the turbine chamber in the centrifugal force direction.

The centrifugal pump of this invention is characterized by the turbine, and the turbine comprises the back plate, the plurality of blades, the cup shaped movable disk plate, and the urging member.

The back plate is a disk shaped component member fixed on the above-mentioned drive shaft and rotating together with the drive shaft, and is a base for disposing the blades hereinafter described.

The plurality of blades are component members, which are formed integrally on a surface of the back plate at the inlet path side in a manner projecting in the axial direction. The blades are for giving kinetic energy to the fluid introduced into the turbine chamber. Further, the blades are disposed radially at intervals of equal angle.

The cup shaped movable disk plate is a cup shaped component member disposed on the drive shaft. The movable disk plate can move in the axial direction relatively with respect to the back plate, and forms the pressure chamber of variable volume between itself and the back plate. A plurality of blade inserting holes are formed on the surface of the movable disk plate at the inlet path side for inserting the blades therethrough. The blade inserting holes have a cross sectional configuration substantially larger than the cross sectional configuration of the blades.

Further, the pressure adjusting holes are formed in the back plate or the movable disk plate at portions thereof adjacent to the drive shaft. The cup shaped movable disk plate moves in the axial direction relatively with respect to the back plate in accordance with the pressures of the fluid introduced into the pressure chamber formed between the movable disk plate and the back plate, thereby varying the height of the blades projecting from the movable disk plate to the inlet path side. The pump capacity of the centrifugal pump has been thus made variable in accordance with the number of the revolutions of a driving source such as an automobile engine and the like.

The urging member is a component member for urging the movable disk plate in the direction toward the back plate by urging forces depending on the pressures of the fluid in the pressure chamber. The movable disk plate moves relatively with respect to the back plate to positions where the urging forces of the urging member and the pressure of the fluid in the pressure chamber reach in equilibrium. For the urging member, the following may be used: a coil spring made of Hooke elasticity material (hereinafter referred to as an ordinary coil spring) whose spring constant is set so that the above-mentioned urging forces are exerted, and a coil spring made of shape memory alloy. When the urging member comprises an ordinary coil spring and a coil spring made of shape memory alloy restoring to a memorized shape at temperatures higher than a predetermined temperature, the urging force of the coil spring made of the shape memory alloy is added to the urging force of the ordinary coil spring to further urge the cup shaped movable disk plate in the direction to the back plate, thereby increasing the height of the blades projecting from the movable disk plate to the inlet path side. In the case that the urging member is thus arranged, not only the pump capacity of the centrifugal pump is made variable in accordance with the number of the revolutions of the driving source, but also the pump capacity thereof is made variable in accordance with the temperatures of the fluid. In this case, the ordinary coil spring and the coil spring made of the shape memory alloy may be disposed either in series to each other or in parallel to each other.

The operation and advantages of the thus arranged centrifugal pump according to this invention will be hereinafter described.

When the drive shaft is rotated by the driving source such as an automobile engine, the turbine fixed on the drive shaft rotates. Then, the back plate being one of the turbine component members, the blades formed on the surface thereof, and the movable disk plate rotate integrally. Thereupon, the blades projecting from the movable disk plate to the inlet path side give the kinetic energy to the fluid introduced into the turbine chamber. The fluid to which the kinetic energy is given passes between the blades, flows out through the outlet path, and circulates in the fluid circulation circuit.

The amount of fluid forwarded per hour by the centrifugal water pump is in proportion to the height of the blade projecting from the movable disk plate into the turbine chamber. Namely, as the rotation speed of the drive shaft increases, the flow amount of the fluid per hour increases proportionally. Also, as the height of the blade projecting from the movable disk plate increases, the flow amount of the fluid increases proportionally.

The height of the blade projecting from the movable disk plate into the turbine chamber is determined by the pressures working on the movable disk plate from the turbine chamber side and from the pressure chamber side. Namely, when the pressure in the pressure chamber is larger than the pressure in the turbine chamber, the movable disk plate moves in a direction away from the back plate and thereby the height of the blades projecting from the movable disk plate become shorter. Contrary to the above situation, i.e., when the pressure in the pressure chamber is smaller than the pressure in the turbine chamber, the movable disk plate moves in a direction closer to the back plate and thereby the height of the blade projecting from the movable disk plate becomes longer.

In the turbine chamber, the level of the pressure is not the same throughout the entire chamber. Namely, the pressure at the drive shaft portion in the turbine chamber is approximately the same as the pressure at the fluid inlet pass. In the turbine chamber, as the distance from the drive shaft increases, the amount of the pressure increases accordingly. In this respect, the pressure at the end of the turbine chamber becomes high and almost the same pressure level as the pressure level at the outlet pass. As described above, the pressure level in the turbine chamber varies at the respective part of the chamber in accordance with the distance from the drive shaft. More specifically, the pressure at a certain part of the pressure chamber is the same as the centrifugal force of the fluid in the same part. This centrifugal force is in proportion to the rotating angular velocity of the fluid. The rotating angular velocity is determined by the rotation of the blades.

On the other hand, the pressure in the pressure chamber is determined by: the amount of the fluid in the pressure chamber, the centrifugal force generated in accordance with the rotating angular velocity of the fluid, the pressure drop of the adjusting holes and the pressure drop of the clearance "c". The amount of the fluid in the pressure chamber is actually determined by the fluid amount leaking to the outlet pass from the clearance "c" formed at the end of the pressure chamber in the centrifugal direction between the back plate and the movable disk plate, and by the fluid amount forwarded to the pressure chamber through the pressure adjusting hole. If the fluid is not forwarded from the pressure adjusting hole, most of the fluid in the pressure chamber is flowed out and thereby, the area of the fluid effecting the movable disk plate (the contact area with the movable disk plate) becomes smaller. Consequently, the pressure force urging and moving the movable disk plate decreases.

Focusing on the centrifugal force generated in accordance with the rotation of the fluid in the pressure chamber with a presumption that the pressure chamber is always filled up with the fluid, if the changes in the fluid amount in the pressure chamber is considered, the calculation of the force effecting the movable disk plate becomes complicated. The pressure chamber is composed of the back plate fixed or held to the drive shaft, a plurality of blades and the movable disk plate. The back plate, blades and movable disk plate are intricately rotated with the drive shaft. Accordingly, the fluid in the pressure chamber always receives the rotary force from the back plate, blades and the movable disk plate, all making up the pressure chamber. In the pressure chamber, there are no parts working to stop the rotations of the fluid. As a result, the large amount of centrifugal force in proportion to the rotating velocity of the fluid is generated in the pressure chamber and accordingly, the movable disk plate receives the large amount of force to move in the direction away from the back plate.

Focusing now on the rotating velocity of the fluid in the turbine chamber, the turbine chamber is formed by an unrotatable housing. In the housing, the movable disk plate and the blades are disposed and both are driven and rotated by the drive shaft. The movable disk plate and the blades both work to rotate the fluid. However, the unrotatable housing works to stop the rotations of the fluid. Due to this feature of the housing, the rotating velocity of the fluid in the turbine chamber always becomes slower than the rotating velocity of the blades and the movable disk plate. Namely, the rotating velocity of the fluid in the turbine chamber is always slower than the rotating velocity of the fluid in the pressure chamber. Accordingly, the centrifugal force of the fluid generated in the turbine chamber is smaller than the centrifugal force of the fluid generated in the pressure chamber. Consequently, the fluid pressure working against the movable disk plate from the pressure chamber is always larger than the fluid pressure working against the movable disk plate from the turbine chamber and therefore, the movable disk plate is pushed to the direction of the turbine chamber.

The centrifugal force of fluid is in proportion to the square of the rotating velocity. Accordingly, as the rotating velocity of the drive shaft increases, the difference between the centrifugal force effecting the pressure chamber and the centrifugal force effecting the turbine chamber increases. As a result, the force which moves the movable disk plate to a direction of the turbine chamber side increases.

On the contrary, as the number of the revolutions of the turbine decreases, the forward pressing force acting on the movable disk plate decreases. Accordingly, the movable disk plate moves in the direction approaching the back plate, namely, it is moved on the drive shaft in the direction getting away from the inlet path by the urging force of the urging member. Thereupon, the height of the blades, projecting from the movable disk plate to the inlet path side, increases, and their effective portions, giving the kinetic energy to the fluid in the centrifugal force direction, increases. Whereby the pump capacity of the centrifugal pump increases.

Here, the forward pressing force acting on the movable disk plate is in proportion to the square of the number of the revolutions of the centrifugal pump. When the number of the revolutions of the driving source such as an automobile engine is small, the forward pressing force is small. Consequently, the height of the blades, projecting from the movable disk plate to the inlet path side, is high, and the pump capacity of the centrifugal pump is large. On the other hand, when the number of the revolutions of the driving source is large, the forward pressing force acting on the movable disk plate increase sharply. Consequently, the height of the blades, projecting from the movable disk plate to the inlet path side, is low, and the pump capacity of the centrifugal pump is small.

The case in which the amount of the fluid in the pressure chamber varies will now be considered. As mentioned before, since the centrifugal force in the pressure chamber is larger, the fluid in the pressure chamber flows out into the outlet pass from the clearance "c" formed between the end portions of the back plate and the movable disk plate in the centrifugal direction. In this case, if the pressure adjusting holes are not provided or the sides of the pressure adjusting holes are not sufficient, the amount of the fluid forwarded in the pressure chamber can not catch up with the amount of the fluid flowing out from the pressure chamber. In this case, the pressure in the pressure chamber decreases and the chamber is turned into a decompression chamber. Namely, the movable disk plate moves in a direction which approaches the back plate by the urging force from the turbine chamber side.

Thus, the centrifugal pump of this invention has a mechanism capable of varying the configuration of the turbine in accordance with the number of the revolutions of the driving source such as an automobile engine. Whereby the ability of making the pump capacity thereof variable is given thereto.

Further, when the urging member comprises an ordinary coil spring and a coil spring made of shape memory alloy restoring to a memorized shape at temperatures higher than a predetermined temperature, the pump capacity of the centrifugal pump of this invention can be made variable in accordance not only with the number of the revolutions of the driving source but also with the temperature variations of the fluid.

When employing the centrifugal pump operating in the above-mentioned manner, the following advantages are available. The circulation amount of the fluid is increased by the increasing pump capacity when the number of the revolutions of the driving force such as an automobile engine is low, namely, when the centrifugal pump rotates at low speeds and the circulation amount of the fluid tends to be insufficient. On the contrary, the circulation amount of the fluid is suppressed by the decreasing pump capacity when the centrifugal pump rotates at high speeds and the circulation amount of the fluid tends to be more than necessary. Therefore, no unnecessary amount of the fluid flows, loss horse power can be reduced, and it is possible to operate the centrifugal pump efficiently.

Moreover, when the urging member is made of an ordinary coil spring and a coil spring made of a shape memory alloy restoring to a memorized shape at temperatures higher than a predetermined temperature, the cup shaped movable disk plate is further urged in the direction to the back plate to increase the height of the blades projecting from the cup shaped movable disk plate to the inlet path side when the fluid temperatures are higher than the predetermined temperature. Consequently, the pump capacity of the centrifugal pump increases, and the fluid can be circulated in a larger amount. Further, when desiring to maintain the high speed rotation of the centrifugal pump but not intending to suppress the circulation amount of the fluid, namely when the driving source such as an automobile engine is running at a high speed, the temperature of the fluid is increased by a certain cause, and the fluid should be circulated in an amount more than an ordinary amount, the coil spring made of the shape memory alloy further urges the cup shaped movable disk plate in the direction to the back plate. As a result, since the pump capacity of the centrifugal pump increases in accordance with the temperatures of the fluid, the circulation amount of the fluid can be increased to amounts more than the predetermined circulation amount while maintaining the high speed rotation of the driving source.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Having generally described this invention, a further understanding can be obtained by reference to certain specific preferred embodiments which are provided herein for purposes of illustration only and are not intended to be limiting unless otherwise specified. The preferred embodiments of a centrifugal water pump according to this invention will be hereinafter described with reference to the drawings.

First Preferred Embodiment

Figure 1:
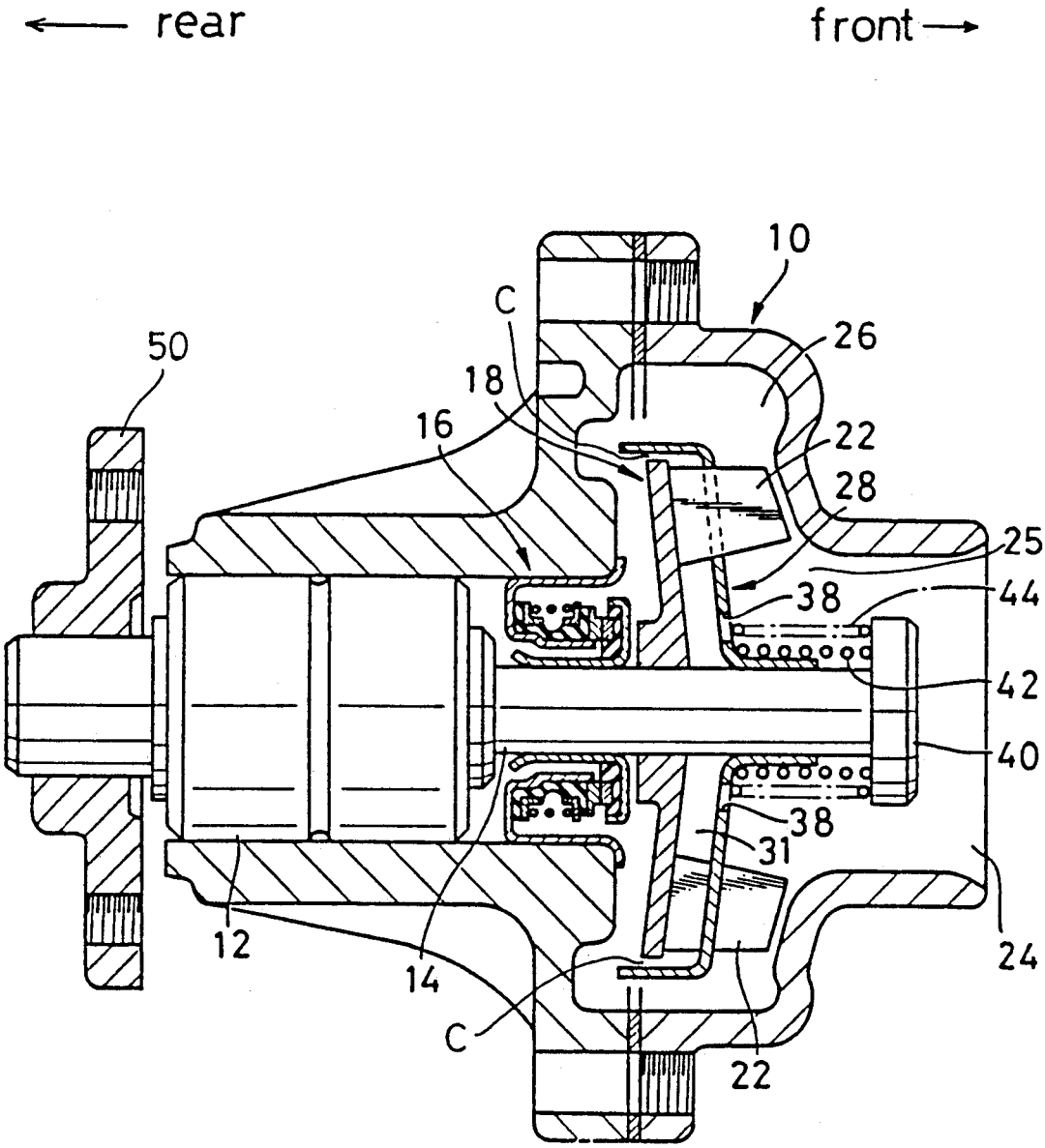
FIG. 1 is a cross sectional view on a first preferred embodiment of a centrifugal water pump according to this invention.

FIG. 1 is a cross sectional view on the first preferred embodiment of a centrifugal water pump according to this invention. A casing 10 defines an inlet path 24, a turbine chamber 25 and an outlet path 26, and is disposed in a manner enclosing component parts hereinafter described. A drive shaft 14 is inserted into a center bore of the casing 10, and held rotatably in the center bore by a bearing 12 disposed at one end thereof and a mechanical seal 16 disposed at a substantially middle portion thereof. Further, an enlarged diameter portion 40 is formed at the other end of the drive shaft 14.

Figure 2:
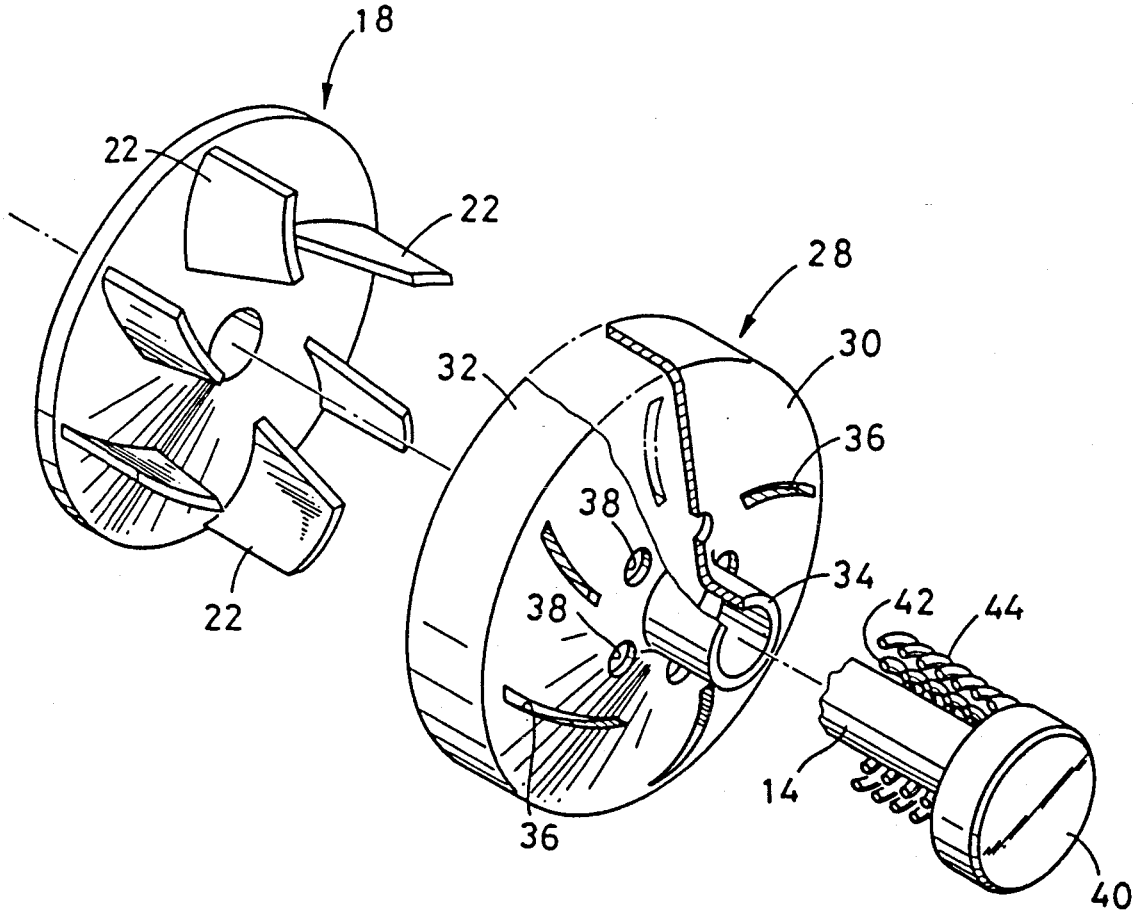
FIG. 2 is an exploded view on a major portion of the first preferred embodiment thereof.

On the drive shaft 14, a back plate 18 is fixed between the mechanical seal 16 and the enlarged portion 40. As illustrated in FIG. 2, a plurality of blades 22, projecting axially to the inlet path 24, are formed integrally on a surface of the back plate 18 at the inlet path 24 side. The plurality of blades 22 are disposed radially at intervals of an equal angle, as also illustrated in FIG. 2.

Further, a movable disk plate 28 is disposed between the back plate 18 and the enlarged diameter portion 40 of the drive shaft 14. The movable disk plate 28 is held in a manner relatively movable with respect to the back plate 18 in the axial direction and rotatable together with the drive shaft 14.

As illustrated in FIG. 2, the movable disk plate 28 has a disk portion 30, a periphery wall portion 32 of a larger diameter projecting from the outer periphery of the disk portion 30 to the back plate 18, and a cylinder portion 34 of a smaller diameter projecting from the surface of the disk portion 30 at the inlet path 24 side to the inlet path 24.

A plurality of blade inserting holes 36 are formed in the disk portion 30 of the movable disk plate 28, and the blade inserting holes 36 are slightly larger than the cross section of the blades 22. When the movable disk plate 28 is assembled with the drive shaft 14, all the blades 22 are respectively inserted into each of the blade inserting holes 36 to project from the disk portion 30 of the movable disk plate 28. In addition, a plurality of pressure adjusting holes 38 are formed at portions adjacent to the drive shaft 14, namely at portions adjacent to the cylinder portion 34, in the disk portion 30 of the movable disk plate 28. The pressure adjusting holes 38 are formed so that they are spaced equally on the same circle.

The inner diameter of the periphery wall portion 32 of the movable disk plate 28 is formed substantially as large as the outer diameter of the back plate 18. However, in this first preferred embodiment, there is formed a clearance "c" between the periphery wall portion 32 and the back plate 18 when the movable disk plate 28 is assembled with the drive shaft 14. Then, a pressure chamber 31 is formed between the movable disk plate 28 and the back plate 18.

The drive shaft 14 is inserted into the cylinder portion 34 of the movable disk plate 28. The movable disk plate 28 is held by the cylinder portion 34 on the drive shaft 14 in a manner relatively movable with respect to the back plate 18 on the drive shaft 14 and rotatable together with the drive shaft 14.

Moreover, between the movable disk plate 28 and the enlarged portion 40 of the drive shaft 14, the following two springs are disposed, i.e., a coil spring 42 made of a spring steel for always urging the movable disk plate 28 to the back plate 18 and a coil spring 44 made of a shape memory alloy, restoring to a memorized shape when the cooling water temperature becomes higher than a predetermined temperature, for further urging the movable disk plate 28 to the back plate 18.

The operation of the first preferred embodiment of the centrifugal water pump thus arranged will be hereinafter described.

When an engine is started, a pulley 50 rotates which is connected to the engine by way of a belt (not shown) and disposed at one end of the drive shaft 14. When the pulley 50 rotates, the drive shaft 14 also rotates, the back plate 18 fixed on the drive shaft 14 rotates, and the blades 22 rotate. The rotation of the blades 22 causes the cooling water to be flown in from the inlet path 24 illustrated in FIG. 1 and to be discharged from the outlet port (not shown) by way of the turbine chamber 25 and the outlet path 26.

Here, when the back plate 18, the blades 22 and the movable disk plate 28 rotate integrally at the angular velocity of $\omega$, the cooling water passing through the turbine chamber 25 disposed on the inlet path 24 side with respect to the movable disk plate 28, namely the cooling water at the right hand side with respect to the movable disk plate 28 in FIG. 1 (hereinafter referred to as "in front of the movable disk plate 28"), is rotated by the disk portion 30 of the movable disk plate 28 and the blades 22 projecting therefrom, and the rotation of the cooling water is restricted by the casing 10. The cooling water is thus rotated at the angular velocity of 0.7 $\omega$ to 0.8 $\omega$. Part of the cooling water in front of the movable disk plate 28 is introduced into the pressure chamber 31 through the clearance between the blades 22 and the blade inserting holes 36 and through the pressure adjusting holes 38. The cooling water introduced into the pressure chamber 31 rotates at the angular velocity of $\omega$ integrally with the back plate 18, the blades 22 placed in the pressure chamber 31 and the movable disk plate 28 which enclose the cooling water. When the cooling water in the pressure chamber 31 flows out through the clearance "c" formed between the back plate 18 and the periphery wall portion 32 of the movable disk plate 28, and when the outside cooling water flows into the pressure chamber 31 through the pressure adjusting holes 38, pressure drops occur for the respective cases. When the pressure drops are equal to each other, no pressing force acts on the movable disk plate 28 in the axial direction. However, when the pressure drops differ from each other, pressing force acts on the movable disk plate 28. Here, the pressure drop resulting from the cooling water passing through the pressure adjusting holes 38 depends on the size of the pressure adjusting holes 38. In this first preferred embodiment, the size of the pressure adjusting holes 38, namely the total area of the pressure adjusting holes 38, is set so that the forward pressing force acts on the movable disk plate 28. Generally speaking, when the cooling water leakage through the blade inserting holes 36 is negligible, the size of the pressure adjusting holes 38 may be set so that the total area of the pressure adjusting holes 38 is greater than the area of the clearance "c" (taken as "A") formed between the back plate 18 and the periphery wall portion 32 of the movable disk plate 28. However, in the case that the area "A" of the clearance "c" is made zero (0) with a packing and the like, the cooling water leakage through the blade inserting holes 36 comes not to be negligible. Therefore, it is necessary to set the total area of the pressure adjusting holes 38 larger than the total area of the clearance formed between the blades 22 and the blade inserting holes 36, but the enlargement is small. However, when a large amount of the cooling water passes through the pressure chamber 31, the angular velocity of the cooling water in the pressure chamber 31 becomes smaller than the angular velocity of the wall surfaces enclosing the cooling water. Accordingly, the force pressing the movable disk plate 28 in the direction toward the inlet path 24 decreases. In addition, the flow amount of the pump itself is equal to the flow amount of the cooling water passing through the pressure chamber 31 by way of the pressure adjusting holes 38 and the clearance "c". Consequently, the flow amount of the pump itself does not decrease when the flow amount of the cooling water passing through the pressure chamber 31 is large and when the height of the blades 22 is reduced. Therefore, it is preferable to make the area "A" of the clearance "c" as small as possible, and it is most preferable to make it zero (0). It is also preferable to make the clearance between the blades 22 and the blade inserting holes 36 as small as possible. If such is the case, the flow of the cooling water passing through the pressure chamber 31 can be ignored even when the areas of the pressure adjusting holes 38 (or the pressure adjusting holes 46 of the second preferred embodiment later described) are enlarged.

Further, in this first preferred embodiment, the coil spring 42 urges the movable disk plate 28 in the direction approaching the back plate 18, namely in the rear direction, with the force in equilibrium with the force resulting from the cooling water pressure increase in the pressure chamber 31 and urging the movable disk plate 28 in the forward direction. Consequently, the movable disk plate 28 is slided to positions where the forward urging force resulting from the cooling water pressure increase in the pressure chamber 31 and the rearward urging force resulting from the coil spring 42 are in equilibrium. Thus, the height of the blades 22 of the back plate 18 projecting from the disk portion 30 of the movable disk plate 28 (hereinafter referred to as an effective blade height) varies in accordance with the cooling water pressure increase in the pressure chamber 31.

To be concrete, when the engine is running at low rpm's, the cooling water pressure increase in the pressure chamber 31 is small, and the movable disk plate 28 is placed at positions a bit toward the rear side, i.e., toward the left side in FIG. 1. Accordingly, the effective blade height gets high, and the pump capacity increases.

On the other hand, when the engine is running at high rpm's, the cooling water pressure increase in the pressure chamber 31 is large, and the movable disk plate 28 is pushed forward. Accordingly, the effective blade height gets low, and the pump capacity decreases.

It is apparent from the foregoing description that the first preferred embodiment of the centrifugal water pump accoding to this invention can circulate a large amount of cooling water when the engine is running at low rpm's and the flow amount of the cooling water tends to be insufficient. On the contrary, the first preferred embodiment thereof can suppress the circulation amount of the cooling water when the engine is running at high rpm's and the cooling water tends to circulate more than necessary.

Here, the force resulting from the cooling water pressure in the pressure chamber 31 and urging the movable disk plate 28 to the inlet path 24 increases in proportion to the square of the number of the pump revolutions. Namely, the force increases sharply when the number of the pump revolutions gets high. However, the effective blade height of the blades 22 can be made optimum for each rpm by setting the spring constant of the ordinary coil spring 42 and the urging force thereof at the time of the installation.

Further, in the idling after a high speed travelling, or when more cooling water should be circulated even at low engine rpm's, the coil spring 44 made of the shape memory alloy restores its memorized shape at temperatures higher than the predetermined temperature, thereby increasing the force urging the movable disk plate 28 rearward. As a result, the movable disk plate 28 is placed further rear side than it is placed at the time when the engine rpm's are as low as those during the idling and when the temperatures of the cooling water is low, and thus the effective blade height of the blades 22 gets high. Accordingly, the pump capacity further increases, and the pump can circulate more cooling water. In addition, when the cooling water temperature has increased because of a certain cause, in other words, when the flow amount should not be suppressed even at high engine rpm's, the coil spring 44 again works in the above-mentioned manner to increase the pump capacity. Also in this case, more cooling water can be circulated accordingly.

As having been described so far, the first preferred embodiment of the centrifugal water pump according to this invention has the capability of varying the pump capacity thereof in accordance with the engine rpm's as well as the capability of varying the pump capacity thereof in accordance with the cooling water temperature variations.

Second Preferred Embodiment

Figure 3:
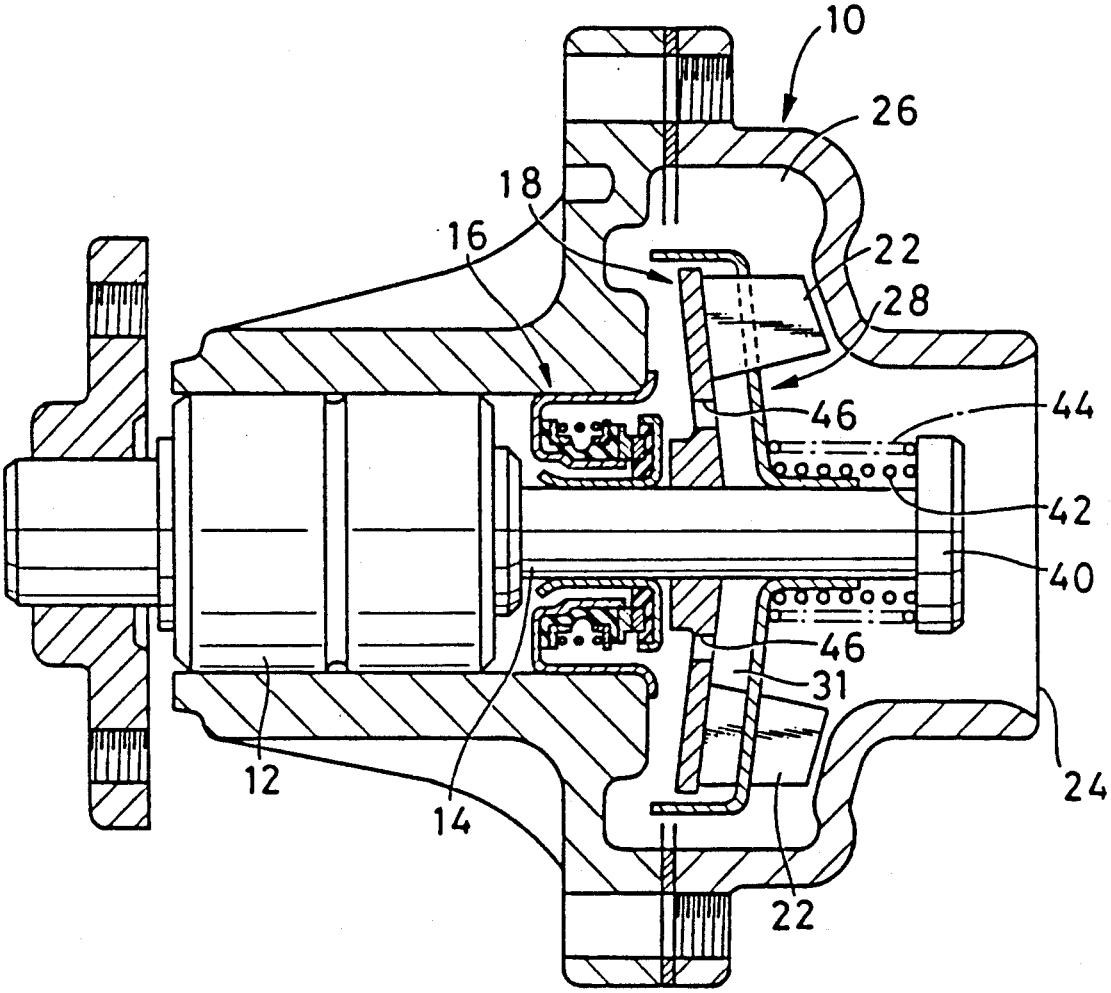
FIG. 3 is a cross sectional view on a second preferred embodiment of a centrifugal water pump according to this invention.

FIG. 3 illustrates a cross sectional view on the second preferred embodiment of a centrifugal water pump according to this invention. In this second preferred embodiment, a plurality of pressure adjusting holes 46 are formed in the back plate 18, no pressure adjusting holes 38 are formed in the disk plate portion 30 of the movable disk plate 28 as in the first preferred embodiment described above. The second preferred embodiment differs from the first preferred embodiment only in this arrangement. Since the other arrangements of the second preferred embodiment are identical with those of the first preferred embodiment, they will not be described herein.

The functions and effects of the plurality of pressure adjusting holes 46 will be hereinafter described. They result from the arrangement that the plurality of pressure adjusting holes 46 is formed in the back plate 18 at portions thereof adjacent to the drive shaft 14. The pressure adjusting holes 46 are spaced equally on the same circle.

However, the total area of the pressure adjusting holes 46 may generally be smaller than the total area of the pressure adjusting holes 38 of the first preferred embodiment. The reason is as follows: The cooling water at the rear of the back plate 18 is rotated by the back plate 18, and the rotation thereof is subjected to the resistance exerted by the inner surface of the casing 10 at the same time. However, the area of the inner surface of the casing 10 exerting the resistance to the rotation of the cooling water is greater than the area of the back plate 18 giving the rotation to the cooling water, the cooling water at the rear of the back plate 18 consequently rotates at the angular velocity of 0.4 $\omega$ to 0.5 $\omega$ when the back plate 18 rotates at the angular velocity of $\omega$. On the other hand, the cooling water in front of the movable disk plate 28 rotates at the angular velocity of 0.7 $\omega$ to 0.8 $\omega$. The radical pressure gradient of the cooling water at the rear of the back plate 18 is smaller than that of the cooling water in front of the movable disk plate 28, because the pressure at a radial position adjacent to the outlet of the back plate 18 is substantially equal to the pressure at any position in the axial direction except the positions in the pressure chamber 31. As a result, the pressure of the cooling water at the rear of the back plate 18 becomes relatively greater than that of the cooling water in front of the movable disk plate 28. Therefore, the total area of the pressure adjusting holes 46 may be smaller than the total area of the pressure adjusting holes 38 of the first preferred embodiment, because the cooling water at the rear of the back plate 18 is more likely to get into the pressure chamber 31 than the cooling water in front of the movable disk plate 28 is. However, the back plate 18 consumes extra power because of the flow of the cooling water flowing into the pressure chamber 31 through the pressure adjusting holes 46, flowing out of the pressure chamber 31 through the clearance "c" formed between the periphery wall portion 32 of the movable disk plate 28 and the back plate 18, and circulating thereafter. The pump efficiency is deteriorated accordingly. Therefore, it is necessary to keep the cooling water leakage through the clearance "c" as small as possible.

The second preferred embodiment of the centrifugal water pump according to this invention arranged in the above-mentioned manner has identical capabilities as those of the first preferred embodiment. The second preferred embodiment thereof has the capability of varying the pump capacity thereof in accordance with the engine rpm's as well as the capability of varying the pump capacity thereof in accordance with the cooling water temperature variations.

Third Preferred Embodiment

Figure 4:
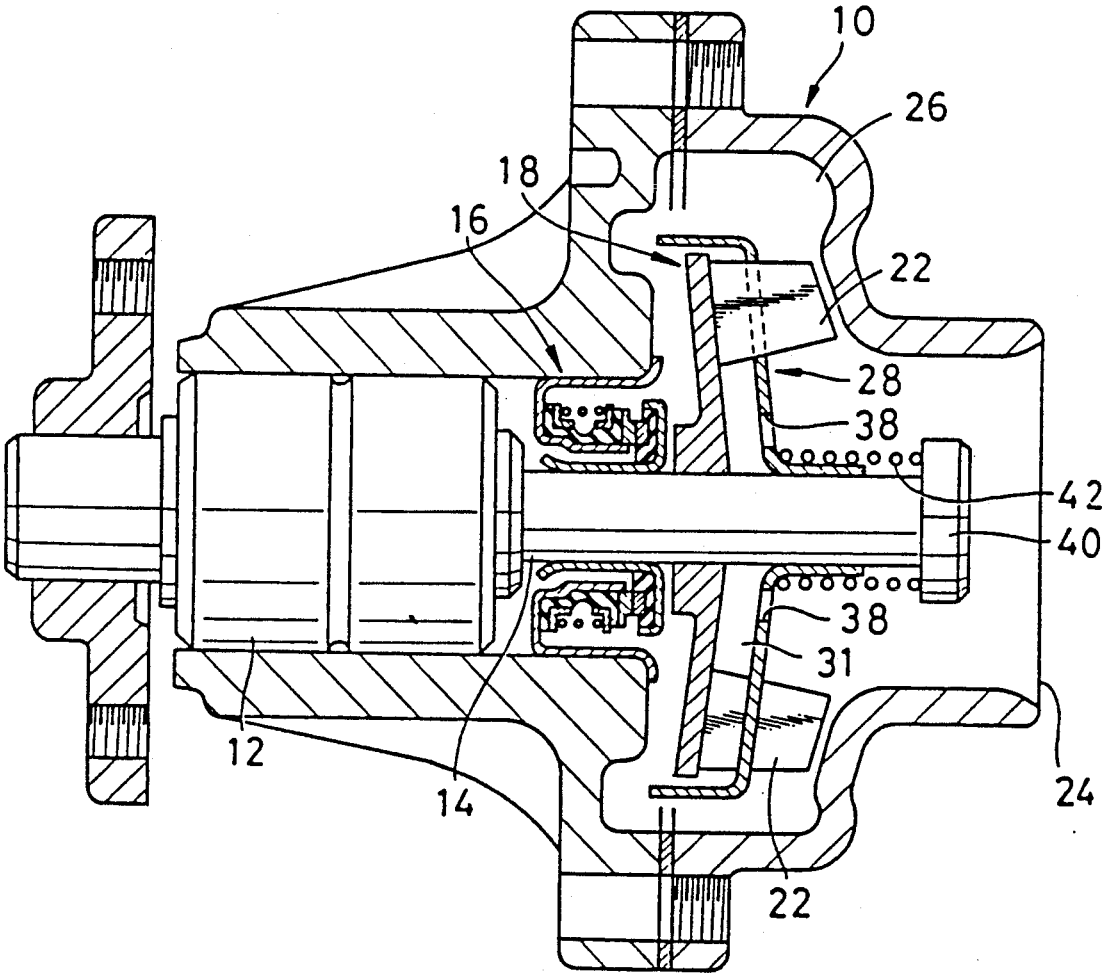
FIG. 4 is a cross sectional view on a third preferred embodiment of a centrifugal water pump according to this invention.

FIG. 4 shows a cross sectional view on the third preferred embodiment of a centrifugal water pump according to this invention. While the urging member of the first preferred embodiment comprises the ordinary coil spring 42 and the coil spring 44 made of the shape memory alloy, this third preferred embodiment has done away with the coil spring 44 made of the shape memory alloy. The third preferred embodiment differs from the first preferred embodiment in this urging member arrangement. The other arrangements of the third preferred embodiment will not be described herein, because the third preferred embodiment has identical arrangements with those of the first preferred embodiment other than the urging member arrangement.

Although the third preferred embodiment of the centrifugal water pump according to this invention thus arranged does not have the capability of varying the pump capacity thereof in accordance with the cooling water temperature variations, it does have the mechanism capable of varying the effective blade height of the blades 22 in accordance with the engine rpm's, thereby giving itself the capability of varying the pump capacity.

Fourth Preferred Embodiment

Figure 5:
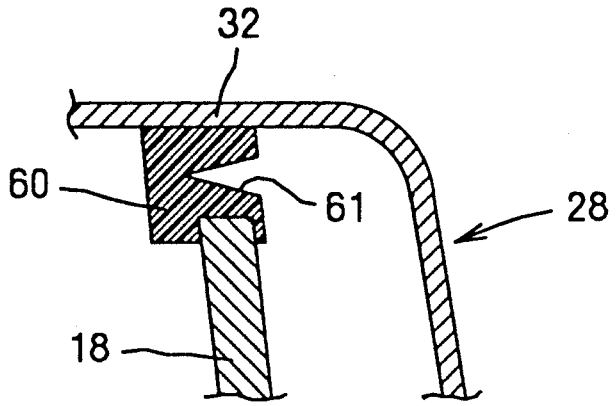
FIG. 5 is a cross sectional view on a major portion of a fourth preferred embodiment of a centrifugal water pump according to this invention.

FIG. 5 illustrates a cross sectional view on the major portion of the fourth preferred embodiment of a centrifugal water pump according to this invention. This fourth preferred embodiment is a modification of the second preferred embodiment, i.e., a packing 60 made of rubber is disposed integrally around the periphery portion of the back plate 18 of the first preferred embodiment, thereby increasing the pump efficiency of the first preferred embodiment.

Namely, the cooling water, flowing into the pressure chamber 31 through the pressure adjusting holes 46 and flowing out of the pressure chamber 31 through the clearance "c," results in the leakage loss of the pump, and deteriorates the efficiency of the pump. On the other hand, in the case that the pressure adjusting holes 38 are provided in the movable disk plate 28 as in the first preferred embodiment, the flow amount of the pump does not decrease in accordance with the reduction of the height of the blades 22, because there is the flow of the cooling water supplied from the inlet path 24 and flowing out of the pressure chamber 31 through the pressure adjusting holes 38, the pressure chamber 31 and the clearance "c." Further, the angular velocity of the cooling water in the pressure chamber 31 becomes smaller than the angular velocity of the back plate 18, thereby decreasing the force pressing the movable disk plate 28 toward the inlet path 24. Accordingly, in this fourth preferred embodiment, the clearance "c" between the back plate 18 and the periphery wall portion 32 of the movable disk plate 28 are sealed up with the packing 60 made of rubber disposed integrally around the periphery portion of the back plate 18, thereby increasing the flow amount of the pump or removing the leakage loss of the pump. Although it is necessary to form the pressure adjusting holes 38 or 46 in the movable disk plate 28 or the back plate 18, the size of the pressure adjusting holes 38 or 46 can be made in a small size substantially when such a packing 60 is employed. However, there arises no inconvenience when the pressure adjusting holes 38 or 46 are enlarged, because there occurs no cooling water flow passing through the pressure chamber 31.

As illustrated in FIG. 5, the packing 60 slides relatively on the inner surface of the periphery wall portion 32 of the movable disk plate 28 as the movable disk plate 28 slides on the drive shaft 14. Further, on the surface of the packing 60 at the side of the movable disk plate 28, a cut-off 61 of wedge shape in the cross section is formed. Whereby the radial force is applied to the packing 60 when the pressure in the pressure chamber 31 increases. That is, the packing 60 is pressed onto the inner surface of the periphery wall portion 32 of the movable disk plate 28 and the periphery portion of the back plate 18, and the leakage at the packing 60 can be thus prevented completely when the pressing force for the installation has been zero (0) substantially. As a result, the cooling water can be prevented from flowing out through the clearance "c," and the flow amount of the pump can be increased or the leakage loss of the pump can be avoided in the fourth preferred embodiment of the centrifugal water pump according to this invention.

The functions and effects of the fourth preferred embodiment other than those of the packing 60 will not be described herein, because the fourth preferred embodiment and the second preferred embodiment function and take effect for similarly except the packing 60.

Having now fully described the invention, it will be apparent to one of ordinary skill in the art that many changes and modifications can be made thereto without departing from the spirit or scope of the invention as set forth herein.

What is claimed is:

1. A centrifugal pump comprising:

a casing defining an inlet path extending at an axial portion thereof, a turbine chamber communicating with said inlet path, and an outlet path disposed at an outer periphery portion of said turbine chamber;

a drive shaft rotatably held in said casing; and a turbine assembly fixed on said drive shaft and disposed rotatably in said turbine chamber;

wherein said turbine assembly comprises:

a disk shaped back plate fixed on said drive shaft;

a plurality of blades formed integrally on a surface of said back plate at the inlet path side, extending in the axial direction, and disposed radially at intervals of equal angle;

a cup shaped movable disk plate comprising an outer peripheral cylindrical part having a uniform inner diameter and covering a peripheral end of said disk-shaped back plate, and a disk part extending radially inward from said cylindrical part and having a plurality of blade inserting holes which are substantially larger than a cross sectional configuration of said blades, said movable disk plate being movably disposed on said drive shaft in the axial direction relatively with respect to said back plate, and forming a pressure chamber between said movable disk plate and said back plate; and an urging member for urging said movable disk plate in a direction toward said back plate;

wherein pressure adjusting holes communicating with said pressure chamber are formed in said movable disk plate at portions thereof adjacent to said drive shaft, and the opening area of said pressure adjusting holes is so set that the pressure in said pressure chamber is relatively greater than the pressure in front of said movable disk plate, whereby a forward pressing force is applied on said movable disk plate to move said movable disk plate in a direction away from said back plate.

2. The centrifugal pump according to claim 1, wherein said urging member comprises a coil spring made of Hooke elasticity material, and a coil spring made of shape memory alloy restoring to a memorized shape at temperatures higher than a predetermined temperature.

3. The centrifugal pump according to claim 2, wherein said coil spring made of Hooke elasticity material and said coil spring made of shape memory alloy are disposed in parallel.

4. A centrifugal pump comprising:

a casing defining an inlet path extending at an axial portion thereof, a turbine chamber communicating with said inlet path, and an outlet path disposed at an outer periphery portion of said turbine chamber;

a drive shaft rotatably held in said casing; and a turbine assembly fixed on said drive shaft and disposed rotatably in said turbine chamber;

wherein said turbine assembly comprises:

a disk shaped back plate fixed on said drive shaft;

a plurality of blades formed integrally on a surface of said back plate at the inlet path side, extending in the axial direction, and disposed radially at intervals of equal angle;

a cup shaped movable disk plate comprising an outer peripheral cylindrical part having a uniform inner diameter and covering a peripheral end of said disk-shaped back plate, and a disk part extending radially inward from said cylindrical part and having a plurality of blade inserting holes which are substantially larger than a cross sectional configuration of said blades, said movable disk plate being movably disposed on said drive shaft in the axial direction relatively with respect to said back plate, and forming a pressure chamber between said movable disk plate and said back plate; and an urging member for urging said movable disk plate in a direction toward said back plate;

wherein pressure adjusting holes communicating with said pressure chamber are formed in said back plate at portions thereof adjacent to said drive shaft, and the opening area of said pressure adjusting holes is so set that the pressure in said pressure chamber is relatively greater than the pressure in front of said movable disk plate, whereby a forward pressing force is applied on said movable disk plate to move said movable disk plate in a direction away from said back plate.

5. The centrifugal pump according to claim 4, wherein said urging member comprises a coil spring made of Hooke elasticity material, and a coil spring made of shape memory alloy restoring to a memorized shape at temperatures higher than a predetermined temperature.

6. The centrifugal pump according to claim 5, wherein said coil spring made of Hooke elasticity material and said coil spring made of shape memory alloy are disposed in parallel.

7. A centrifugal pump comprising:

a casing defining an inlet path extending at an axial portion thereof, a turbine chamber communicating with said inlet path, and an outlet path disposed at an outer periphery portion of said turbine chamber;

a drive shaft rotatably held in said casing; and a turbine assembly fixed on said drive shaft and disposed rotatably in said turbine chamber;

wherein said turbine assembly comprises:

a disk shaped back plate fixed on said drive shaft;

a plurality of blades formed integrally on a surface of said back plate at the inlet path side, extending in the axial direction, and disposed radially at intervals of equal angle;

a cup shaped movable disk plate comprising an outer peripheral cylindrical part having a uniform inner diameter and covering a peripheral end of said disk-shaped back plate, and a disk part extending radially inward from said cylindrical part and having a plurality of blade inserting holes which are substantially larger than a cross sectional configuration of said blades, said movable disk plate being movably disposed on said drive shaft in the axial direction relatively with respect to said back plate, and forming a pressure chamber between said movable disk plate and said back plate; and an urging member for urging said movable disk plate in a direction toward said back plate;

wherein pressure adjusting holes communicating with said pressure chamber are formed in said movable disk plate at portions thereof adjacent to said drive shaft, and the opening area of said pressure adjusting holes is so set that the pressure in said pressure chamber is relatively greater than the pressure in front of said movable disk plate, wherein a forward pressing force is applied on said movable disk plate and a sealing member is disposed between said back plate and said movable disk plate.

8. The centrifugal pump according to claim 7, wherein said urging member comprises a coil spring made of Hooke elasticity material, and a coil spring made of shape memory alloy restoring to a memorized shape at temperatures higher than a predetermined temperature.

9. The centrifugal pump according to claim 7, wherein said coil spring made of Hooke elasticity material and said coil spring made of shape memory alloy are disposed in parallel.

10. A centrifugal pump comprising:

a casing defining an inlet path extending at an axial portion thereof, a turbine chamber communicating with said inlet path, and an outlet path disposed at an outer periphery portion of said turbine chamber;

a drive shaft rotatably held in said casing; and a turbine assembly fixed on said drive shaft and disposed rotatably in said turbine chamber;

wherein said turbine assembly comprises:

a disk shaped back plate fixed on said drive shaft;

a plurality of blades formed integrally on a surface of said back plate at the inlet path side, extending in the axial direction, and disposed radially at intervals of equal angle;

a cup shaped movable disk plate comprising an outer peripheral cylindrical part having a uniform inner diameter and covering a peripheral end of said disk-shaped back plate, and a disk part extending radially inward from said cylindrical part and having a plurality of blade inserting holes which are substantially larger than a cross sectional configuration of said blades, said movable disk plate being movably disposed on said drive shaft in the axial direction relatively with respect to said back plate, and forming a pressure chamber between said movable disk plate and said back plate; and an urging member for urging said movable disk plate in a direction toward said back plate;

wherein pressure adjusting holes communicating with said pressure chamber are formed in said back plate at portions thereof adjacent to said drive shaft, and the opening area of said pressure adjusting holes is so set that the pressure in said pressure chamber is relatively greater than the pressure in front of said movable disk plate, wherein a forward pressing force is applied on said movable disk plate and a sealing member is disposed between said back plate and said movable disk plate.

11. The centrifugal pump according to claim 10, wherein said urging member comprises a coil spring made of Hooke elasticity material, and a coil spring made of shape memory alloy restoring to a memorized shape at temperatures higher than a predetermined temperature.

12. The centrifugal pump according to claim 10, wherein said coil spring made of Hooke elasticity material and said coil spring made of shape memory alloy are disposed in parallel.

* * * * *

UNITED STATES PATENT AND TRADEMARK OFFICE

CERTIFICATE OF CORRECTION

PATENT NO. : 5,169,286

DATED : December 8, 1992

INVENTOR(S) : YUTAKA YAMADA

It is certified that error appears in the above-identified patent and that said Letters Patent is hereby corrected as shown below:

In column 5, line 43, after "increases." insert -- Therefore, as the number of the revolutions of the turbine increases, the movable disk plate moves in the direction getting away from the back plate, namely, it moves on the drive shaft to the inlet path against the urging force of the urging member. Thereupon, the height of the blades, projecting from the movable disk plate to the inlet path side, decreases, and their effective portions, giving the kinetic energy to the fluid in the centrifugal force direction, decreases. Whereby the pump capacity of the centrifugal pump decreases.--;

UNITED STATES PATENT AND TRADEMARK OFFICE

CERTIFICATE OF CORRECTION

PATENT NO. : 5,169,286

DATED : December 8, 1992

INVENTOR(S) : YUTAKA YAMADA

It is certified that error appears in the above-identified patent and that said Letters Patent is hereby corrected as shown below:

line 67, change "increase" to --increases--.

In column 13, line 37, delete "for"; same line after "except" insert --for--.

Signed and Sealed this

Eleventh Day of January, 1994

*Attest:*

Bruce Lehman

BRUCE LEHMAN

*Attesting Officer*

*Commissioner of Patents and Trademarks*